US007292193B2

(12) United States Patent
Jang

(10) Patent No.: US 7,292,193 B2
(45) Date of Patent: Nov. 6, 2007

(54) METHOD FOR TUNING ANTENNA MODULE IN PORTABLE WIRELESS TERMINAL AND BUILT-IN ANTENNA MODULE USING THE SAME

(75) Inventor: Chang-Won Jang, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 75 days.

(21) Appl. No.: 11/248,036

(22) Filed: Oct. 12, 2005

(65) Prior Publication Data

US 2006/0139218 A1 Jun. 29, 2006

(30) Foreign Application Priority Data

Dec. 24, 2004 (KR) ..... 10-2004-0112163

(51) Int. Cl.
*H01Q 1/24* (2006.01)

(52) U.S. Cl. ..... 343/702; 343/767; 343/846

(58) Field of Classification Search ..... 343/702, 343/767, 846, 700 MS
See application file for complete search history.

(56) References Cited

U.S. PATENT DOCUMENTS 6,985,108 B2 * 1/2006 Mikkola et al. ..... 343/700 MS
2003/0160728 A1 * 8/2003 Fukushima et al. ..... 343/702

* cited by examiner

*Primary Examiner*—Hoang V. Nguyen
(74) *Attorney, Agent, or Firm*—The Farrell Law Firm

(57) ABSTRACT

Disclosed is a method for tuning an antenna module in a portable wireless terminal and built-in antenna module using the same. According to the method and built-in antenna module, the built-in antenna module is provided with a plate type radiator defining a slot with a predetermined width to form a pattern. The plate type radiator is provided with downwardly protruded feed and ground pins that are spaced apart, and at least one passive element having a predetermined value is connected to the radiator to optimally tune the antenna module. Therefore, various frequency response properties of the built-in antenna module can be attained by altering such a passive element as a variable design parameter without changing the radiator. Also, this construction can take the place of a matching circuit in a signal line, such that radiation performance can be increased without insertion loss.

8 Claims, 11 Drawing Sheets

METHOD FOR TUNING ANTENNA MODULE IN PORTABLE WIRELESS TERMINAL AND BUILT-IN ANTENNA MODULE USING THE SAME

PRIORITY

This application claims priority under 35 U.S.C. § 119 to an application entitled "Method for Tuning Antenna Property in Portable Wireless Terminal and Built-In Antenna Module Using Thereof" filed in the Korean Intellectual Property Office on Dec. 24, 2004 and assigned Serial No. 2004-112163 and the contents of which are herein incorporated by reference.

BACKGROUND OF THE INVENTION

1. Field of the Invention

The present invention relates to a built-in antenna module of a portable wireless terminal and, more particularly, to a method for tuning an antenna module in a portable wireless terminal and built-in antenna module using the same, in which a matching unit is added to facilitate the design of a Planar Inverted-F Antenna (PIFA).

2. Discussion of the Prior Art

Mobile wireless terminals, such as Personal Communication Service (PCS) terminals, Digital Cellular System (DCS) terminals, Global Positioning System (GPS) terminals, Personal Digital Assistants (PDAs), cellular phones and wireless notebooks, are popular and have introduced various functions and designs. New terminals, being introduced, must be small, slim and lightweight. At the same time, the terminals are required to have improved functionality. Therefore, the design of the terminals is focused on size reduction while maintaining or improving the functions demanded by the public.

Today, a rod antenna (also known as a whip antenna) and a helical antenna are widely used owing to their good omnidirectional radiation properties. The rod antenna and the helical antenna protrude outward from the terminal and are easy to break when dropped. This fragility decreases the portability of the terminal. Therefore, a plate type built-in antenna, installed within the terminal, has been widely used in recent times. This arrangement is also called a built-in antenna, internal antenna, or intenna. Various efforts are being made to improve the performance and capability of the built-in antenna.

The built-in PIFA antenna includes a plate type radiator and is electrically connected to a multiple-layer mainboard of a main body of a portable wireless terminal. Also, the PIFA includes two feed lines. One feed line is electrically connected to a feed portion of the mainboard, and the other is electrically connected to a ground portion of the mainboard for grounding. The plate type radiator can function at a desired performance when it is spaced apart from a conductive layer (ground layer) of the mainboard. Therefore, the plate type radiator is mounted on a carrier with a predetermined height to provide separation and then the carrier is mounted on the mainboard.

When designing the PIFA, fixed design parameters and variable design parameters are considered to optimize the performance of the PIFA. Different design parameters may be invoked depending on the requirements necessary to implement various features of the portable wireless terminal. The fixed design parameters, such as radiator length, radiator width, and the distance between the radiator and the ground layer, are firmly fixed depending on the type and size of the portable wireless terminal. Therefore, adjustment of the variable design parameters is important in antenna matching to obtain optimized antenna performance. The variable design parameters may include a feed pin location, feed pin and ground pin widths, the distance between the feed pin and the ground pin, and a pattern configuration formed on the radiator.

However, the tuning of the antenna device using the variable design parameters requires many test samples. Also, since the antenna has to be tested with respect to each variable design parameter, tuning the antenna device is a lengthy process.

SUMMARY OF THE INVENTION

The present invention provides a method for tuning an antenna module in a portable wireless terminal and built-in antenna module using the same, which does not require extensive testing because a desired antenna property can be easily attained without considering variable design parameters.

Also, the present invention provides a method for tuning an antenna module in a portable wireless terminal and built-in antenna module using the same, in which a matching circuit is installed separate from a mainboard of the portable wireless terminal, to easily perform resonant frequency tuning and bandwidth tuning.

Further, the present invention provides a method for tuning an antenna module in a portable wireless terminal and built-in antenna module using the same, in which a passive element with a specific characteristic value is used to easily perform an antenna tuning for a Planar Inverted-F antenna (PIFA). The passive element is used instead of, for example, adjusting the distance between a feed pin and a ground pin.

According to an aspect of the present invention, a method is provided for tuning an antenna module in a portable wireless terminal, in which the antenna module is provided with a plate type radiator in which a slot with a predetermined width is defined to form a pattern and the plate type radiator is provided with downwardly protruding feed and ground pins that are spaced apart. The method includes the step of connecting at least one passive element having a predetermined value to the radiator to optimally tune the antenna module.

According to another aspect of the present invention, a built-in antenna module in a portable wireless terminal is provided, including a mainboard having a feed portion and a ground portion for the built-in antenna module; a plate type radiator mounted on the mainboard, the plate type radiator having a feed pin and a ground pin that are electrically connected to the feed portion and the ground portion, respectively; and at least one passive element having a predetermined value, the passive element being electrically connected to a predetermined portion of the radiator.

According to the present invention, a matching unit, which is conventionally located on a mainboard, is installed on an antenna radiator to attain various advantages. For example, though the matching unit on the mainboard is considered as a fixed design parameter because it is hard to replace, the matching unit on the radiator can be easily replaced with another one to tune the antenna module. Therefore, the antenna tuning can be carried out conveniently and quickly while considering less variable design parameters.

The matching unit may also be a well-known passive element. Passive elements with various characteristic values may be used depending on the various fixed design parameters of the radiator. The passive element may be selected from the group consisting of a resistor (R), a capacitor (C), an inductor (I), and combinations thereof.

Consequently, adjustment of the variable design parameters, such as the feed pin width and length, the ground pin width and length, and the distance between the feed pin and the ground pin, is minimized when tuning the antenna module. Thereby, productivity and yield are improved without frequent sample replacement and the accompanying loss of time.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings. A detailed description of well-known features will be omitted for conciseness.

A slide-type portable wireless terminal is illustrated to describe the present invention. However, the present invention is not limited to the illustrated terminal. The present invention can be applied to various kinds of wireless devices with a plate type built-in antenna module, such as PDAs, other types of portable wireless terminals, and wireless notebooks.

Figure 1:
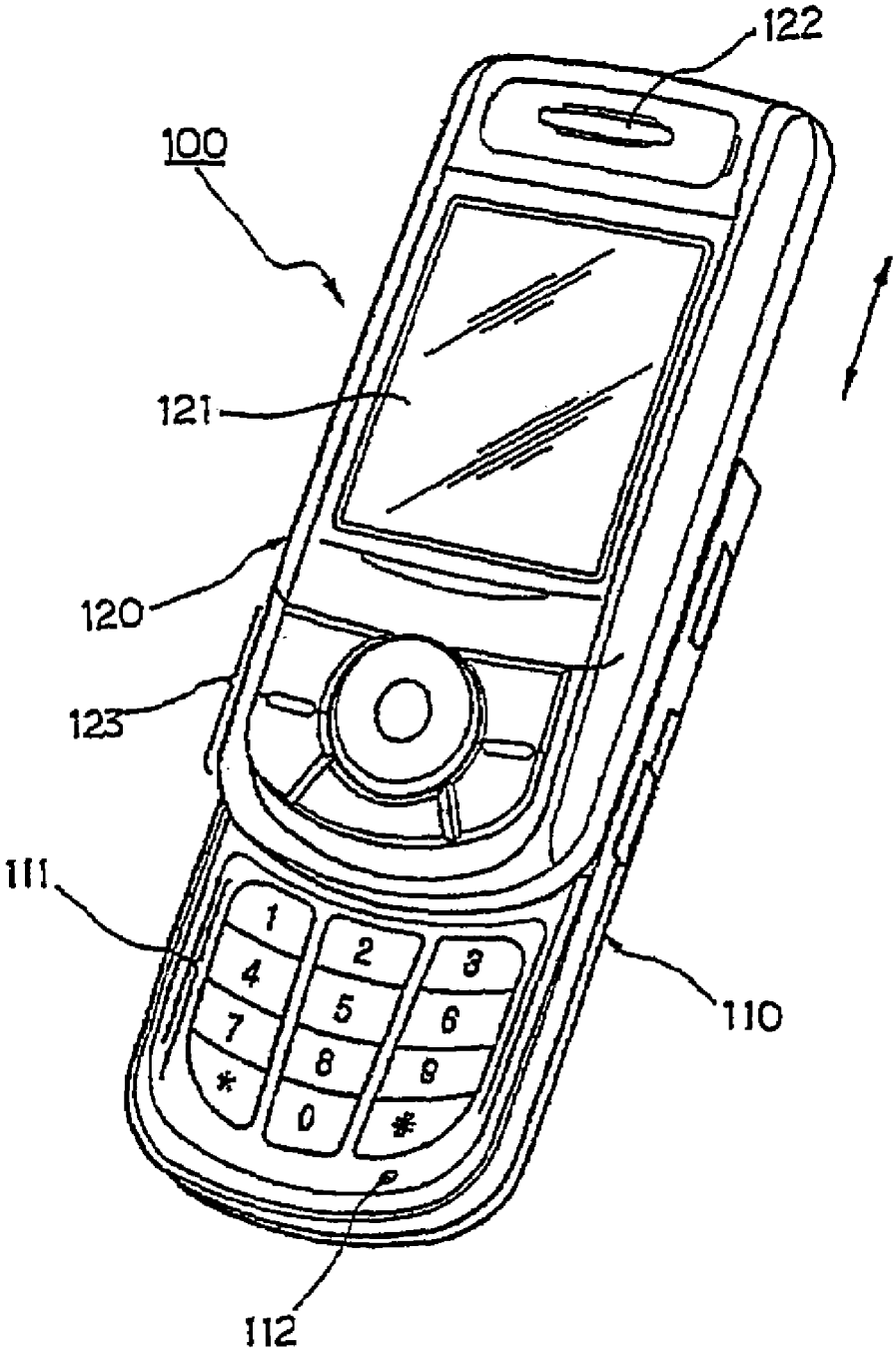
FIG.1 PRIOR ART
FIG. 1 is a front perspective view of a typical slide type portable wireless terminal.
Figure 2:
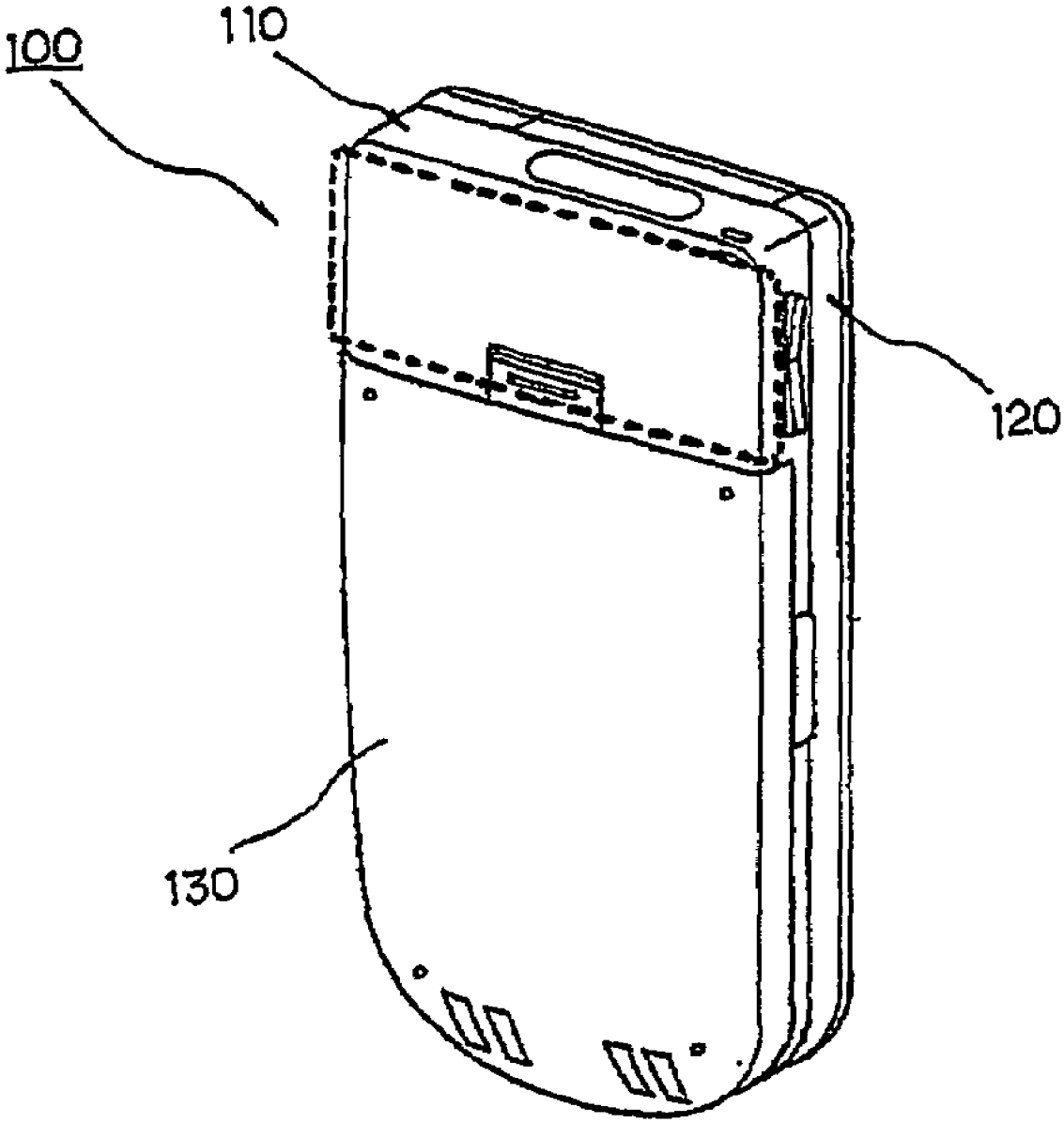
FIG.2 PRIOR ART
FIG. 2 is a rear perspective view of a typical slide type portable wireless terminal, showing an installation location of a built-in antenna module.

FIG. 1 is a front perspective view of a typical slide type portable wireless terminal, and FIG. 2 is a rear perspective view of a typical slide type portable wireless terminal, showing an installation location of a built-in antenna module.

Referring to FIGS. 1 and 2, a portable wireless terminal 100 such as a slide-type terminal is illustrated. The portable wireless terminal 100 includes a main body 110 and a slide body 120, slidably coupled to the main body 110. The slide body 120 is capable of sliding on the main body 110 within a predetermined range in the length direction. The slide body 120 includes a display 121 at a front, an earpiece 122 above the display 121, and a first keypad assembly 123 under the display 121. The display 121 may be a wide color Liquid Crystal Display (LCD) module. Also, the display 121 may be a touch screen panel. The earpiece 122 is provided to output voice or sound. The first keypad assembly 123 may include navigation buttons.

The main body 110 may include a second keypad assembly 111 on a front lower portion and a microphone 112 under the second keypad assembly 111. The second keypad assembly 111 shows up when the slide terminal is opened. The second keypad assembly 111 may be a 3×4 keypad assembly. The microphone 112 is provided to receive the user's voice. Also, the main body 110 includes a battery pack 130 and a built-in antenna module. The battery pack 130 is installed on a back of the main body 110 to supply power to the portable wireless terminal 100. The built-in antenna is installed in the main body 110 at a dashed-line portion depicted in FIG. 2.

Figure 3:
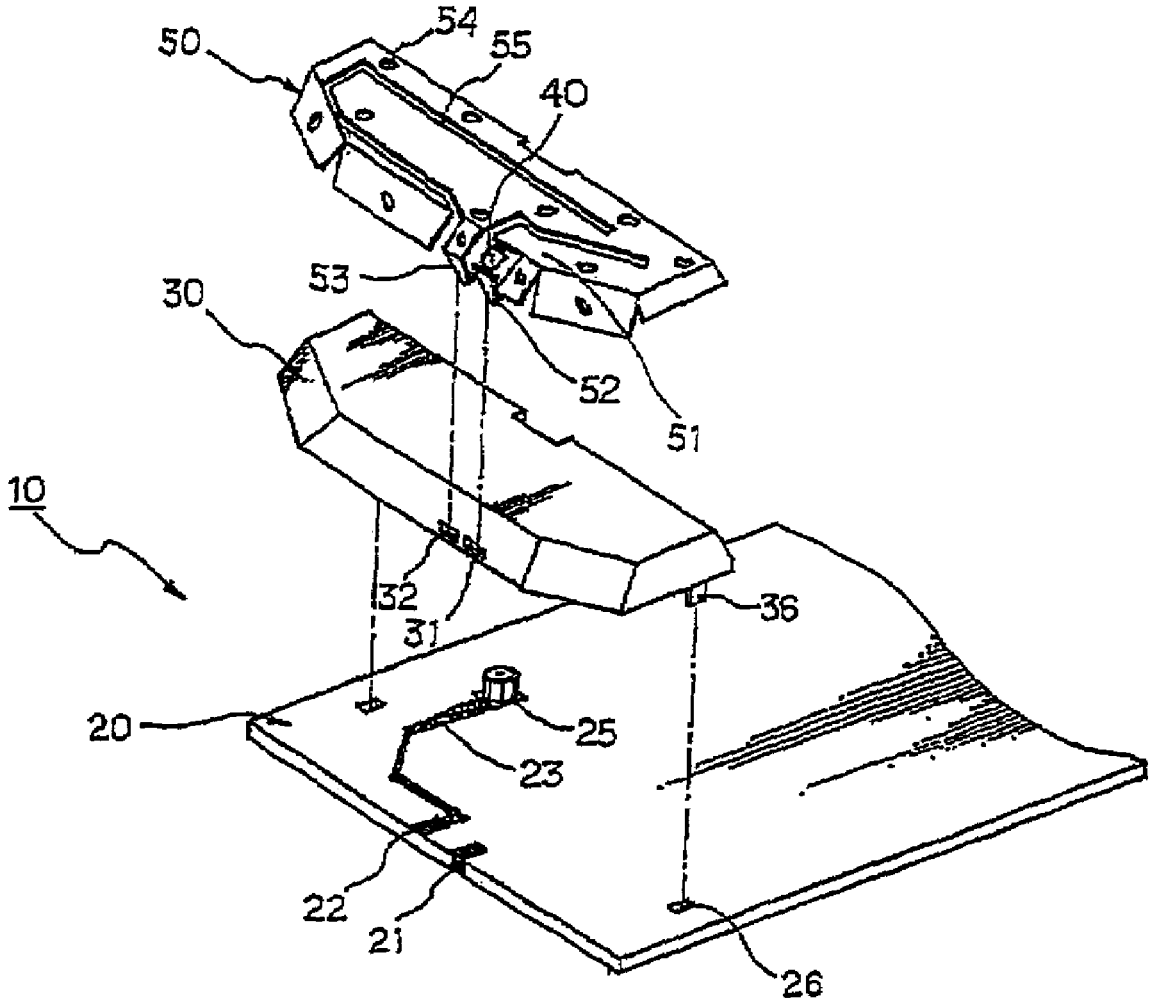
FIG. 3 is an exploded perspective view of a built-in antenna module according to an embodiment of the present invention.
Figure 4:
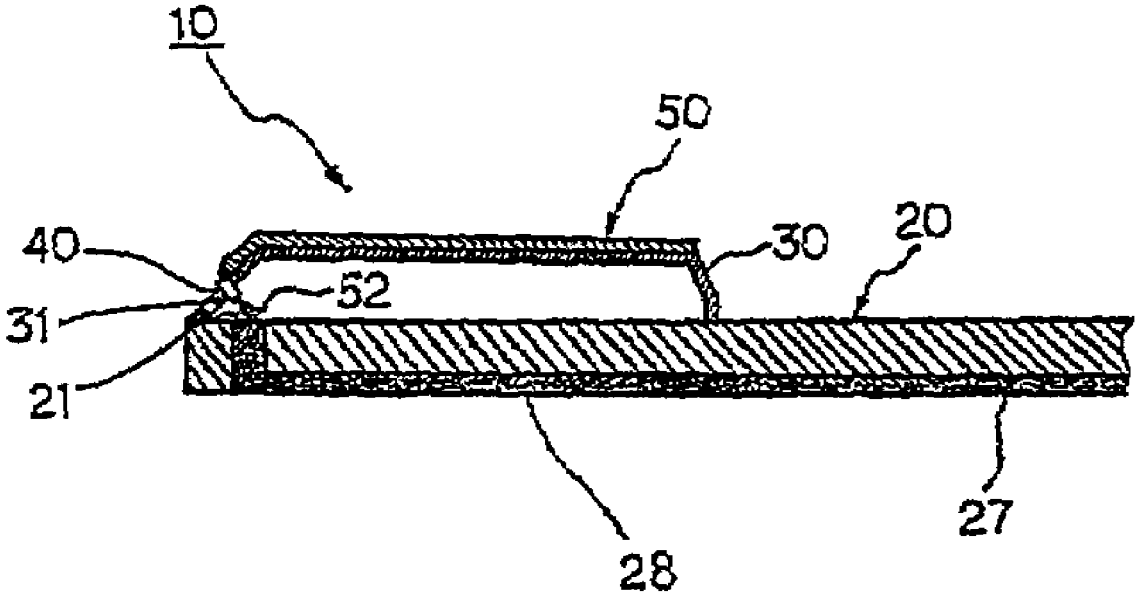
FIG. 4 is an assembled side sectional view of the built-in antenna module depicted in FIG. 3.

FIG. 3 is an exploded perspective view of a built-in antenna module according to an embodiment of the present invention, and FIG. 4 is an assembled side sectional view of the built-in antenna module depicted in FIG. 3.

Referring to FIGS. 3 and 4, a built-in antenna module 10 includes a mainboard 20 installed in the portable wireless terminal 100 and a radiator 50 installed on the mainboard 20. To install the radiator 50 on the mainboard 20, the radiator 50 may be fixed on a top of a carrier 30 having a predetermined height, and the carrier 30 may be mounted on the mainboard 20. The radiator 50 has a plate shape and defines a slot 55 having a predetermined width to form a pattern. The configuration of the pattern may be changed depending on terminal features and operating frequency band.

The mainboard 20 includes a ground portion 21 and a feed portion 22. The radiator 50 includes a ground pin 52 and a feed pin 53. The ground portion 21 and feed portion 22 are electrically connected with the ground pin 52 and feed pin 53, respectively. The feed portion 22 is electrically connected to a Radio Frequency (RF) connector 25 by a pattern 23 formed on the mainboard 20.

The carrier 30, on which the radiator 50 is fixed, may be made of synthetic resin. Since the radiator 50 is made of thin metal plate, the radiator 50 can be easily deformed when it is directly fixed to the mainboard. This deformation may cause degradation in radiation pattern of the radiator 50. Therefore, the radiator is instead fixed to the carrier 30 to prevent deformation and degradation of the radiation pattern. A plurality of small holes 54 may be defined in the radiator 50 to fix the radiator 50 to the carrier 30 by ultrasonic welding. The carrier 30 may define through-holes 31 and 32 through which the ground pin 52 and feed pin 53 are respectively inserted to make contact with the ground portion 21 and feed portion 22. The carrier 30 also includes downward protrusions 36 at both sides. The mainboard 20 defines corresponding protrusion holes 26 through which the protrusions 36 are tightly inserted, such that the carrier 30 can be securely fixed to the mainboard 20.

A passive element 40 is installed in the radiator 50. To install the passive element 40, the ground pin 52 of the radiator 50 may be bisected in the middle and the passive element 40 may be electrically connected between the bisected ends of the ground pin 52. That is, the ground pin 52 is cut in two parts, and both ends of the passive element 40 are respectively connected to the cut ends of the ground pin 52 by soldering. The passive element 40 may be a resistance (R), a capacitor (C), or an inductor (L), each having a predetermined characteristic value such as resistance, capacitance or inductance.

A capacitor with a predetermined capacitance is illustrated as a non-exclusive example of the passive element 40. When fixed design parameters such as the width and height of the radiator are determined, a variable design parameter can be adjusted by changing the passive element 40 with new one having a different characteristic value to carry out an antenna matching in order to optimize the performance of the built-in antenna module. Though one passive element 40 is used in this embodiment illustrated in FIGS. 3 and 4, two or more passive elements may be used in the radiator 50.

Figure 5:
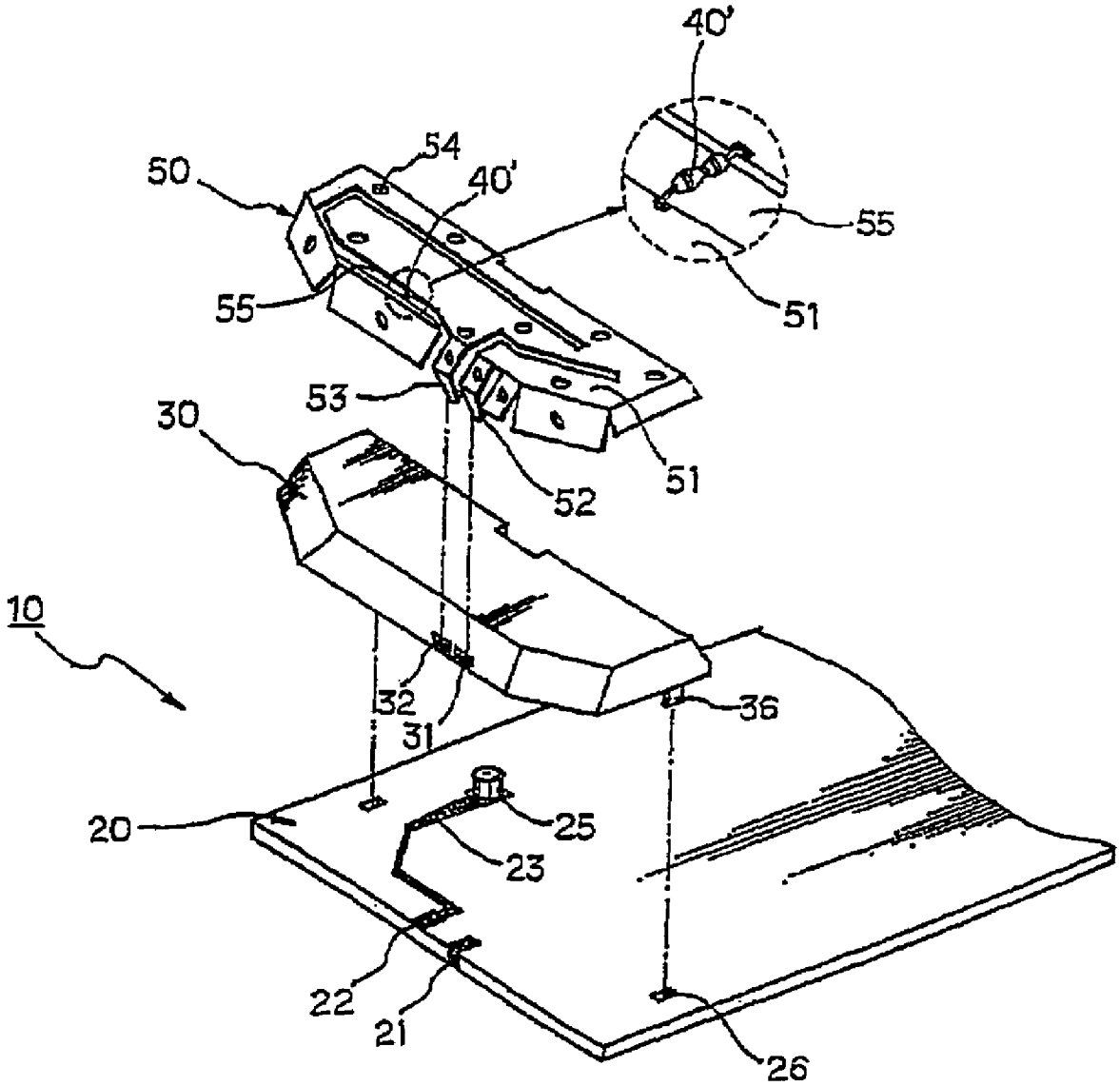
FIG. 5 is an exploded perspective view of a built-in antenna module according to another embodiment the present invention.

FIG. 5 is an exploded perspective view of a built-in antenna module according to another embodiment the present invention. Since the radiator 50, the carrier 30, and the mainboard 20 are already described with reference to FIGS. 3 and 4, descriptions thereof will be omitted.

Referring to FIG. 5, a passive element such as a resistor 40' is installed across the slot 55 of the radiator 50. Resistors having different resistance values can be applied to establish an optimized antenna matching condition.

One or more passive elements of the same kind may be used for the antenna matching. Also, a plurality of passive elements of different kinds may be used together for the antenna matching.

Figure 6A:
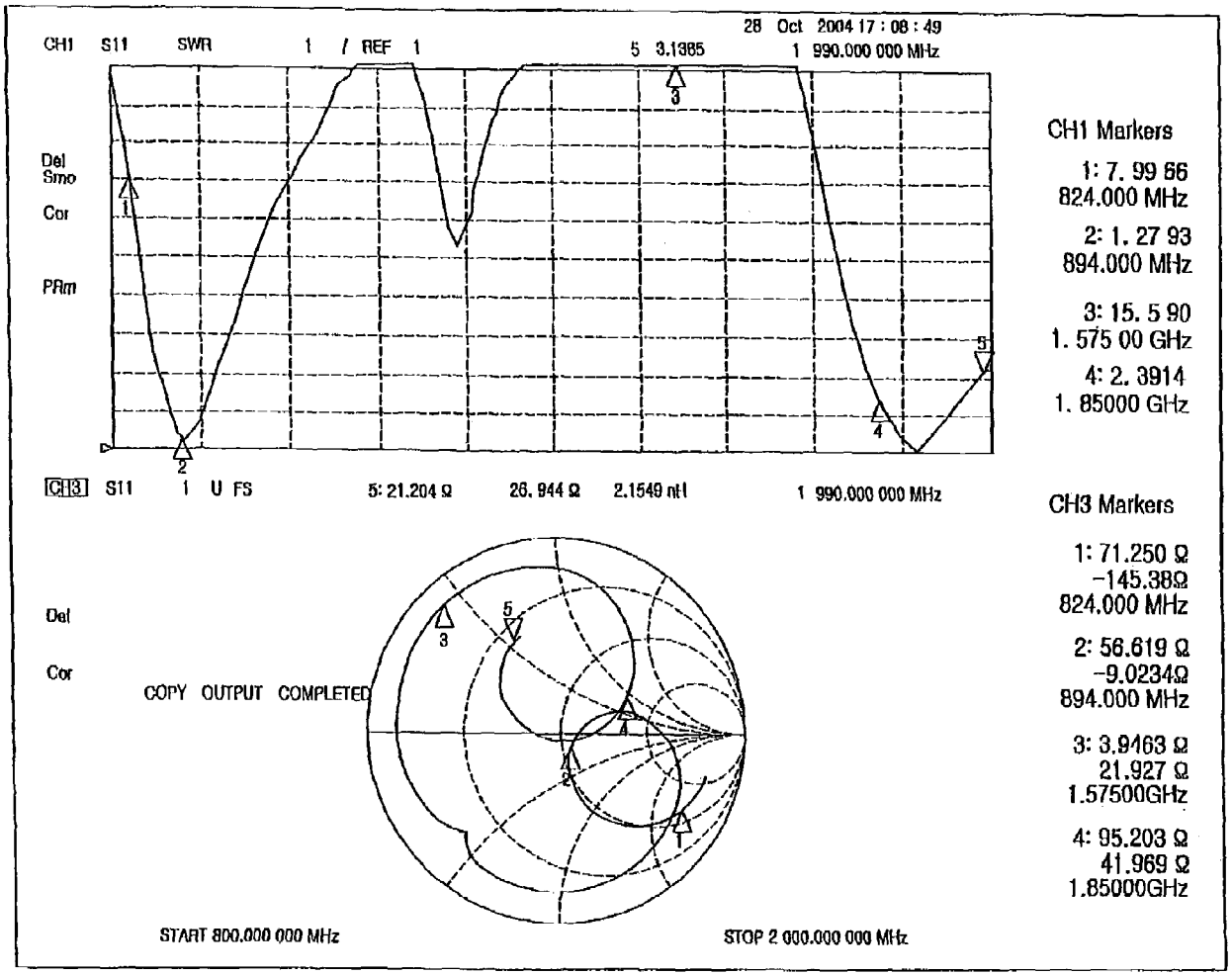
FIGS. 6A to 6C are graphs showing Voltage Standing Wave Ratio (VSWR) of built-in antenna modules, each being obtained by applying a capacitor of a different capacitance.
Figure 6B:
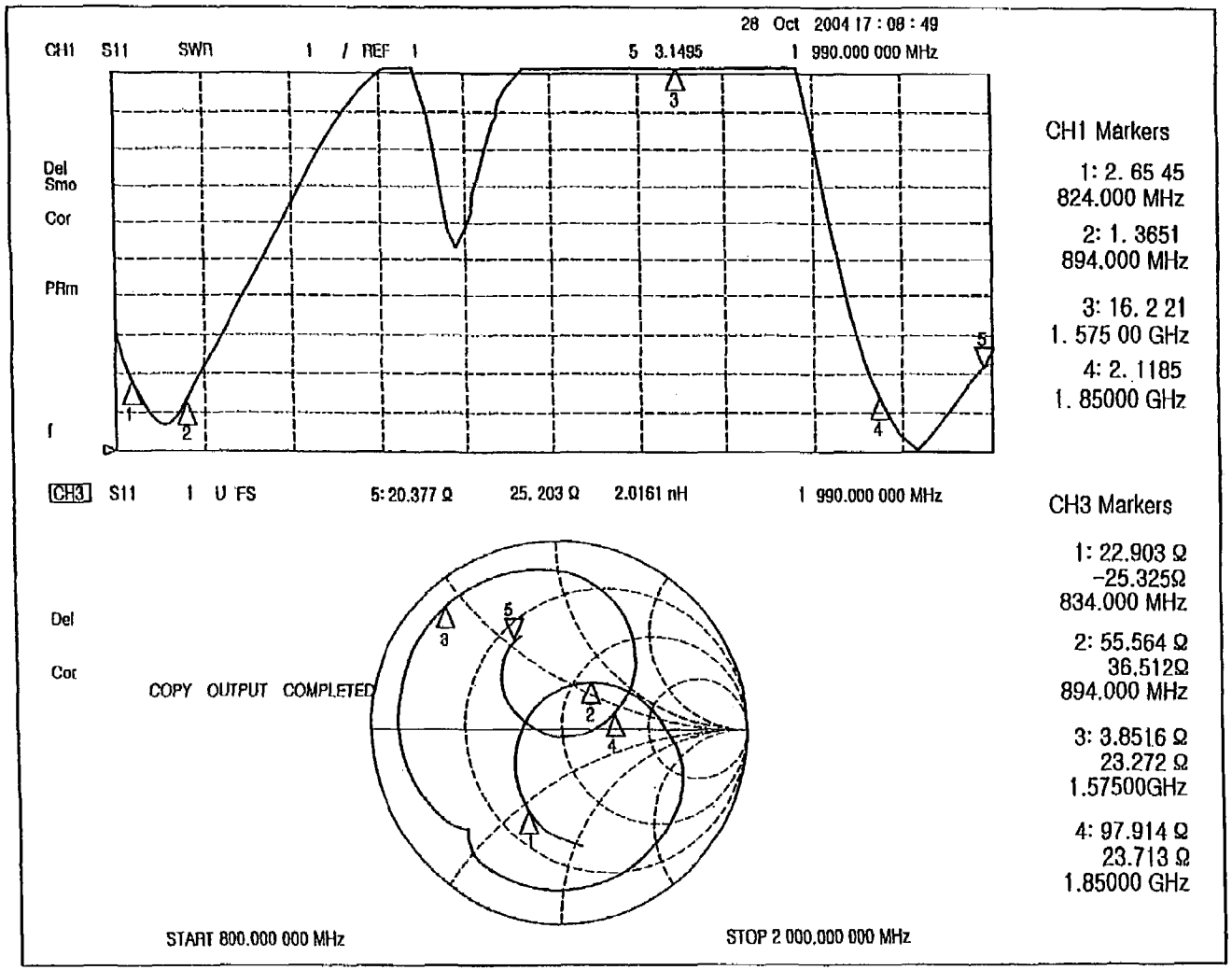
Figure 6C:
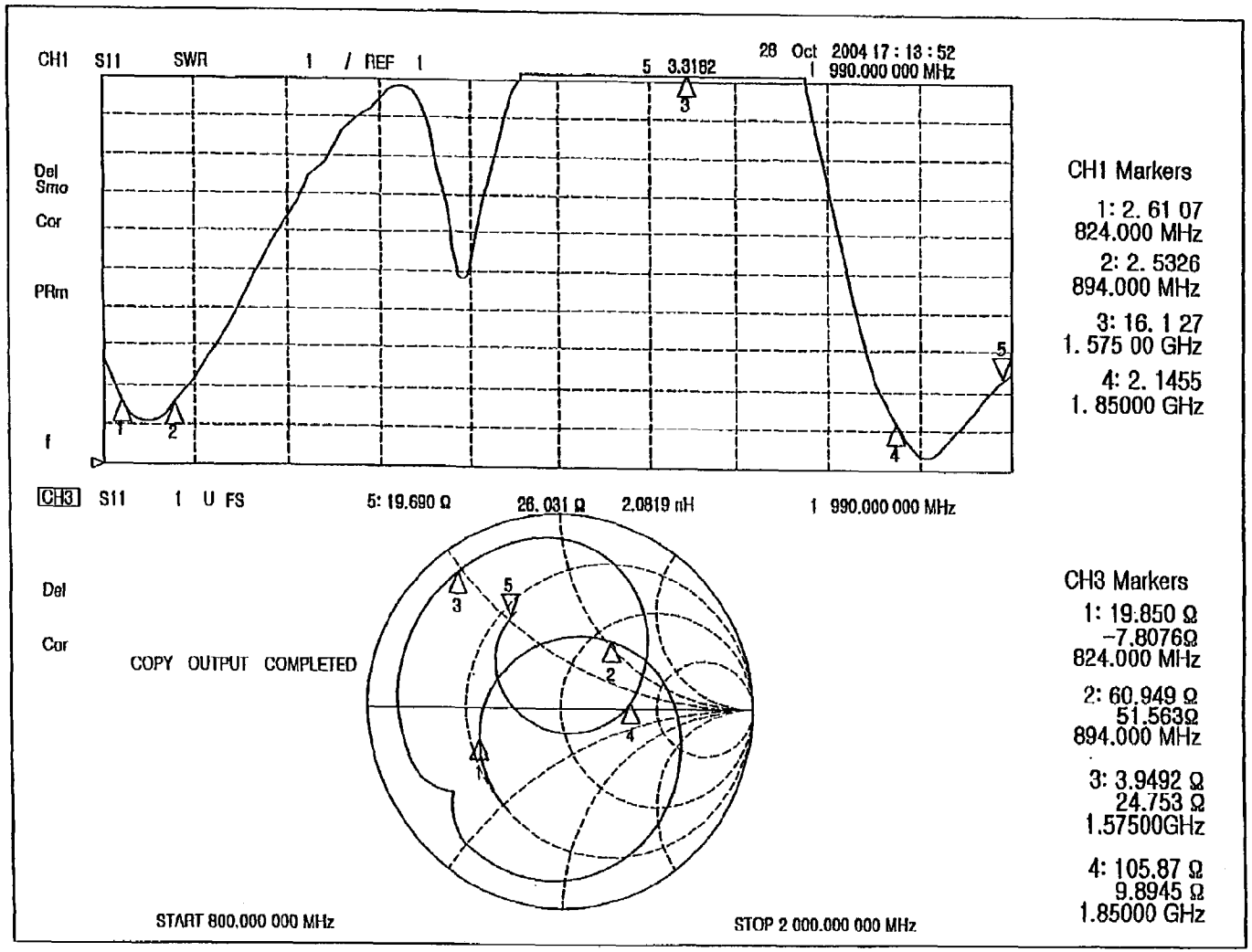

FIGS. 6A to 6C are graphs showing Voltage Standing Wave Ratio (VSWR) of built-in antenna modules, each being obtained by applying a capacitor of a different capacitance to the built-in antenna module shown in FIG. 4. FIGS. 6A to 6C are obtained by applying a 12-pF, 27-pF, and 47-pF capacitor, respectively.

Referring to FIGS. 6A to 6C, the graphs show that the frequency response property and bandwidth are changed depending on the capacitance of the capacitor in 800-MHz band. Therefore, the built-in antenna can be tuned to have a desired property by selecting a proper capacitor.

Figure 7:
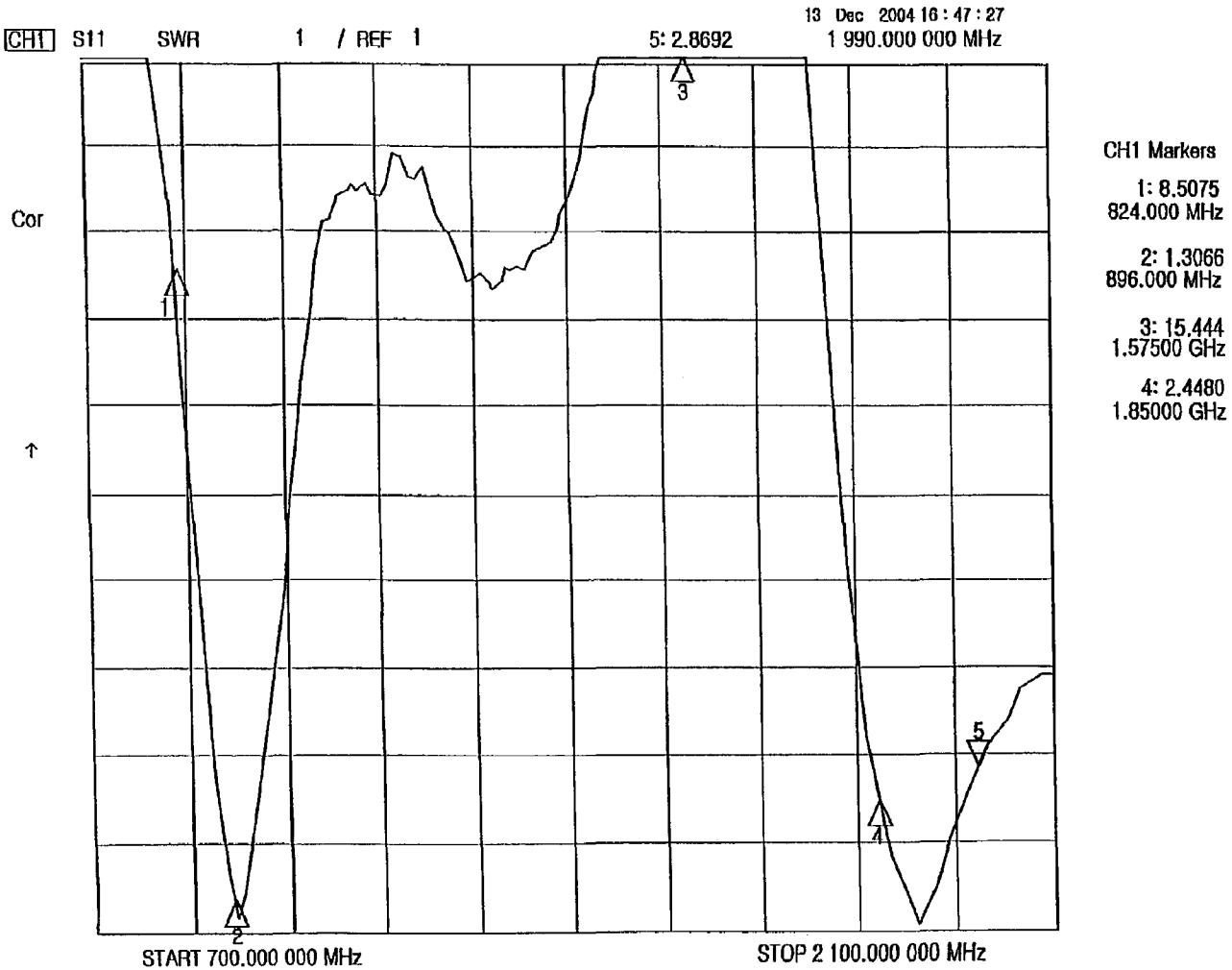
FIG. 7 is a graph showing VSWR of a built-in antenna module without a matching unit.
Figure 8:
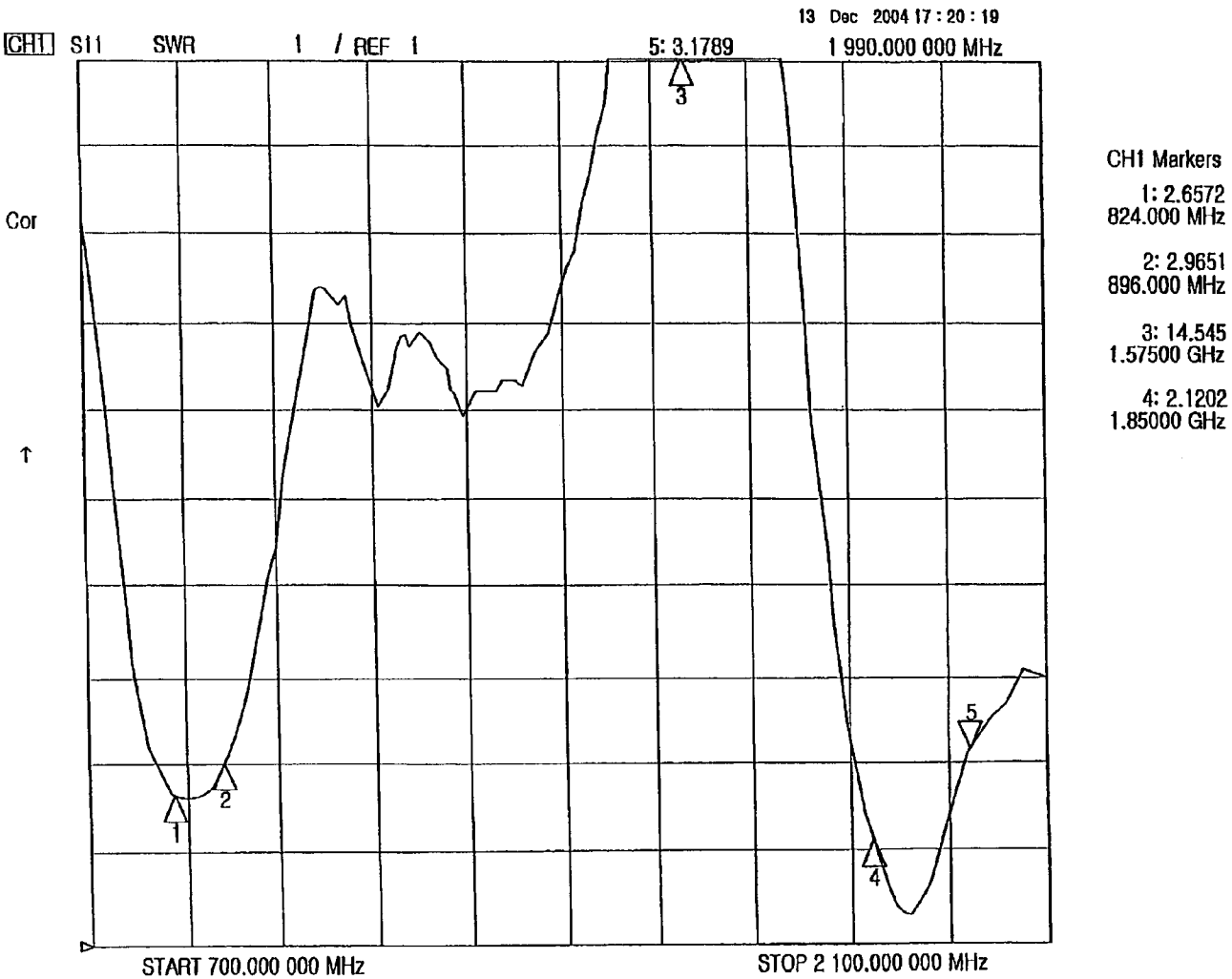
FIG. 8 is a graph showing VSWR of a built-in antenna module with a 1.2-nH inductor as a matching unit.
Figure 9:
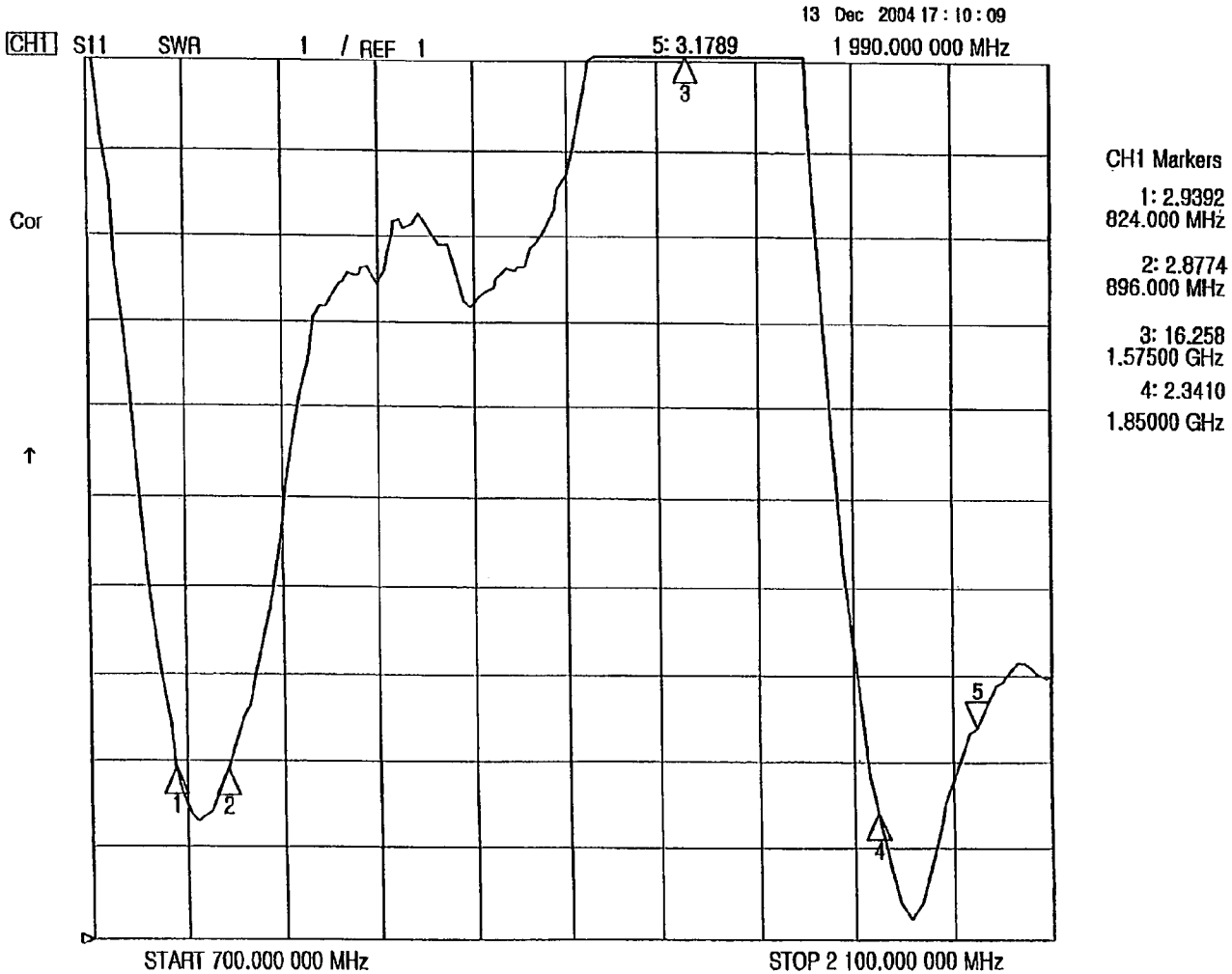
FIG. 9 is a graph showing VSWR of a built-in antenna module with a 56-pF capacitor as a matching unit.

FIG. 7 is a graph showing VSWR of a built-in antenna module without a matching unit. FIG. 8 is a graph showing VSWR of a built-in antenna module with a 1.2-nH inductor as a matching unit. FIG. 9 is a graph showing VSWR of a built-in antenna module with a 56-pF capacitor as a matching unit.

Referring to FIG. 8, a graph is obtained by applying a 1.2-nH inductor to the radiator 50 between the ground pin 52 and radiation surface. When the graph in FIG. 7 obtained without a matching unit is compared with the graph in FIG. 8, the frequency response property of the built-in antenna module is changed. That is, VSWRs are changed in Code Division Multiple Access (CDMA) band (between marker 1 and marker 2): from 8.5:1 to 2.6:1 at marker 1, and from 1.3:1 to 2.9:1 at marker 2. As shown, bandwidth is widened though the VSWR at marker 2 is increased.

Referring to FIG. 9, a graph is obtained by applying a 56-pF capacitor to the radiator 50 between the ground pin 52 and the radiation surface. When the graph in FIG. 7 obtained without a matching unit is compared with the graph in FIG. 9, the frequency response property of the built-in antenna module is changed. That is, VSWRs are changed in Code Division Multiple Access (CDMA) band (between marker 1 and marker 2): from 8.5:1 to 2.9:1 at marker 1, and from 1.3:1 to 2.8:1 at marker 2. As shown, bandwidth is slightly narrowed when compared with the graph in FIG. 8.

As described above, when the passive element, such as the inductor and the capacitor, is disposed between the ground pin and radiation surface, the characteristic value of the passive element changes the frequency response property and bandwidth of the built-in antenna module. Therefore, various frequency response properties can be attained via altering a variable design parameter, such a passive element, without physically changing the radiator. Also, the application of the passive element can take the place of a matching circuit in a signal line, such that radiation performance can be increased without insertion loss.

The foregoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A method for tuning an antenna module in a portable wireless terminal, the antenna module being provided with a plate type radiator in which a slot with a predetermined width is defined to form a pattern, the plate type radiator being provided with downwardly protruding feed and ground pins that are spaced apart, the method comprising the steps of:

bisecting the ground pin into two bisected ground ends for an electrical ground connection; and connecting at least one ground passive element between the bisected ground ends.

2. The method of claim 1, wherein the ground passive element is selected from a group comprising a resistor (R), a capacitor (C), an inductor (I), and combinations thereof.

3. A built-in antenna module in a portable wireless terminal, comprising:

a mainboard having a feed portion and a ground portion for the built-in antenna module;

a plate type radiator mounted on the mainboard, the plate type radiator having a feed pin and a ground pin that are electrically connected to the feed portion and the ground portion, respectively, the ground pin being bisected into two bisected ground ends for an electrical ground connection; and at least one ground passive element, being electrically connected between the bisected ground ends.

4. The built-in antenna module of claim 3, wherein the ground passive element is selected from a group comprising a resistor (R), a capacitor (C), an inductor (I), and combinations thereof.

5. The built-in antenna module of claim 4, wherein the ground passive element is electrically connected between the bisected ground ends by soldering.

6. The built-in antenna module of claim 3, wherein the radiator defines a slot with a predetermined width to form a pattern, and a radiator passive element is installed across the slot for making an electric radiator connection.

7. The built-in antenna module of claim 6, wherein the radiator passive element is selected from a group comprising a resistor (R), a capacitor (C), an inductor (I), and combinations thereof.

8. The built-in antenna module of claim 3, wherein the radiator is fixed on a top of a carrier having a predetermined height, the carrier being fixed on the mainboard.

* * * * *